US009706314B2

(12) United States Patent
Jenison et al.

(10) Patent No.: US 9,706,314 B2
(45) Date of Patent: Jul. 11, 2017

(54) SYSTEM AND METHOD FOR SELECTIVE ENHANCEMENT OF SPEECH SIGNALS

(75) Inventors: Rick Lynn Jenison, Madison, WI (US); Keith Raymond Kluender, Madison, WI (US); Joshua Michael Alexander, Lafayette, IN (US)

(73) Assignees: Wisconsin Alumni Research Foundation, Madison, WI (US); Purdue Research Foundation, West LaFayette, IN (US)

( * ) Notice: Subject to any disclaimer, the term of this patent is extended or adjusted under 35 U.S.C. 154(b) by 1990 days.

(21) Appl. No.: 12/955,343

(22) Filed: Nov. 29, 2010

(65) Prior Publication Data

US 2012/0134522 A1 May 31, 2012

(51) Int. Cl.

| | |
|---|---|
| ***H04R 25/00*** | (2006.01) |
| *G10L 25/90* | (2013.01) |
| *G10L 21/0364* | (2013.01) |

(52) U.S. Cl.

CPC ..... *H04R 25/505* (2013.01); *G10L 25/90* (2013.01); *G10L 2021/03643* (2013.01)

(58) Field of Classification Search

CPC ..... H04R 25/505; G10L 25/90; G10L 2021/03643

USPC ..... 381/320; 704/233

See application file for complete search history.

(56) References Cited

U.S. PATENT DOCUMENTS

| | | | |
|---|---|---|---|
| 3,180,936 | A | 4/1965 | Schroeder |
| 4,051,331 | A | 9/1977 | Strong et al. |
| 4,185,168 | A | 1/1980 | Graupe et al. |
| 4,249,042 | A | 2/1981 | Orban |
| 4,366,349 | A | 12/1982 | Adelman |

(Continued)

FOREIGN PATENT DOCUMENTS

| | | | |
|---|---|---|---|
| EP | 0556992 | A1 | 8/1993 |

OTHER PUBLICATIONS

Partial International Search Report, PCT/US2011/051443; 2 pages.

Holt, L., et al., Neighboring Spectral Content Influences Vowel Identification, J. Acoust. Soc. Am. 108(2):710-722, 2000.

Lotto, A., et al., Perceptual Compensation for Coarticulation by Japanese Quail (*Coturnix coturnix japonica*), J. Acoust. Soc. Am. 102(2), Pt. 1, pp. 1134-1140, 1997.

(Continued)

*Primary Examiner* — Davetta W Goins

*Assistant Examiner* — Phylesha Dabney

(74) *Attorney, Agent, or Firm* — Quarles & Brady, LLP

(57) ABSTRACT

A system and method for selectively enhancing an audio signal to make sounds, particularly speech sounds, more distinguishable. The system and method are designed to divide an input auditory signal into a plurality of spectral channels having associated unenhanced signals and perform enhancement processing on a first subset of the spectral channels and not perform enhancement processing on a second subset of the spectral channels. The enhancement processing is performed by determining an output gain for at least the first subset of spectral channels based on a time-varying history of energy of the unenhanced signals associated with each channel in the first subset of the spectral channels and applying the output gain for each of the first subset of the spectral channels to the unenhanced signals to form enhanced signals associated with each of the first subset of the spectral channels. The system and method are then designed to combine the plurality of enhanced signals associated with each of the first subset of the spectral channels and the unenhanced signals associated with each of the second subset of the spectral channels to form a selectively enhanced output auditory signal.

20 Claims, 4 Drawing Sheets

(56) References Cited

U.S. PATENT DOCUMENTS

| | | | | |
|---|---|---|---|---|
| 4,396,806 | A | 8/1983 | Anderson | |
| 4,454,609 | A | 6/1984 | Kates | |
| 4,630,304 | A | 12/1986 | Borth et al. | |
| 4,630,305 | A | 12/1986 | Borth et al. | |
| 4,700,361 | A | 10/1987 | Todd et al. | |
| 4,701,953 | A | 10/1987 | White | |
| 4,852,175 | A | 7/1989 | Kates | |
| 5,027,410 | A | 6/1991 | Williamson et al. | |
| 5,029,217 | A | 7/1991 | Chabries et al. | |
| 5,388,185 | A | 2/1995 | Terry et al. | |
| 5,479,560 | A | 12/1995 | Mekata | |
| 5,742,689 | A | 4/1998 | Tucker et al. | |
| 5,793,703 | A | 8/1998 | Shippey | |
| 6,732,073 | B1 | 5/2004 | Kluender et al. | |
| 8,233,651 | B1 * | 7/2012 | Haller | 381/318 |
| 2008/0144869 | A1 | 6/2008 | Paludan-Mueller et al. | |

OTHER PUBLICATIONS

Lotto, A., et al., General Contrast Effects in Speech Perception: Effect of Preceding Liquid on Stop Consonant Identification, Perception & Psychophysics 60(4):602-619, 1998.

Nilsson, M., et al., Development of the Hearing in Noise Test for the Measurement of Speech Reception Thresholds in Quiet and in Noise, J. Acoust. Soc. Am. 95(2):1085-1099, 1994.

Summerfield, Q., Auditory Enhancement of Changes in Spectral Amplitude, J. Acoust. Soc. Am. 81(3):700-708, 1987.

Vaidyanathan, P., Quadrature Mirror Filter Banks, M-Band Extensions and Perfect-Reconstruction Techniques, IEEE ASSP Magazine, Jul. 1987, pp. 4-20.

White, M., Compression Systems for Hearing Aids and Cochlear Prostheses, Journal of Rehabilitation Research and Development 23(1):25-39, 1986.

* cited by examiner

SYSTEM AND METHOD FOR SELECTIVE ENHANCEMENT OF SPEECH SIGNALS

STATEMENT REGARDING FEDERALLY SPONSORED RESEARCH

This invention was made with government support under Grant No. DC004072 and DC010601 awarded by the National Institute of Health. The government has certain rights in this invention.

REFERENCE TO RELATED APPLICATION

N/A.

FIELD OF THE INVENTION

This invention relates, generally, to audio signal processing and, particularly, to systems and methods for selectively enhancing speech signals to improve speech recognition by individuals and automated processes.

BACKGROUND OF THE INVENTION

The art of processing of audio signals spans a wide range of technologies and efforts. Despite the plethora of signal processing advancements related to audio signals, the processing of audio signals including or created as part of oral communications and, particularly, human speech remains a substantial challenge. For example, despite substantial investments in research and resources, speech processing and, particularly, speech recognition systems are still quite limited. These limits are due, at least in part, to the complexities of human speech and a limited understanding of natural auditory and cognitive processing capabilities. For example, the ability to recover speech information, despite dramatic articulatory and acoustic assimilation and coarticulation of speech sounds, poses substantial hurdles to enhancement of speech signals and automated processing of the underlying information communicated in speech. These hurdles are further compounded when, for example, the individual receiving the speech signals has an impairment.

Reports indicate that only about 20 percent of the more than 30 million adults with hearing loss in this country currently use hearing aids, and by 2030 there could be over 40 million adults and over 2 million children with hearing loss in the United States. The National Council on Aging indicates that untreated hearing loss of any degree has significant consequences on people's social lives, emotional health, mental health, and physical well-being. Furthermore, the Better Hearing Institute estimates that earning potential for individuals with untreated hearing loss is reduced by an average of $23,000 per year, which is twice as much for individuals with hearing aids. When multiplied by the number of American workers with hearing loss, the magnitude of total annual lost income is staggering. While many factors are related to these numbers, hearing aid performance is an important variable as indicated by the finding that only about half of all users are satisfied with how their hearing aids perform in noise. Advancements in hearing aid performance have the potential to improve quality of life for more than 10 percent of the American population as well as productivity of the average hearing-impaired worker. U.S. Pat. No. 6,732,073 to Kluender et al. provides a substantial summary of some of the difficulties and impediments to speech signal processing and enhancement and is incorporated herein by reference.

For some time, it has been understood that at least two components of sensorineural hearing loss (SNHL) reduce listeners' access to speech information. The first is a loss of sensitivity, which results in an attenuation of speech. To overcome a loss of attenuation, the signal simply needs to be made louder and noise reduced. Accordingly, many hearing aids focus on using wide dynamic range compression and various processing strategies to boost the signal-to-noise ratio, such as noise reduction and directional microphones. The second component of SNHL is a loss of selectivity, which results in a blurring of spectral detail, or distortion. Unfortunately, due to this second component of SNHL, simple amplification of speech does not necessarily improve the listeners' ability to discern the information conveyed in the speech.

Due to substantial research, it is now established that listeners with SNHL often have compromised access to frequency-specific information because spectral detail is often smeared, or blurred, by broadened auditory filters. Loss of sharp tuning in auditory filters generally increases with degree of sensitivity loss and is due, in part, to a loss or absence of peripheral mechanisms responsible for suppression. It has been learned that in the non-impaired cochlea different frequency components of a signal serve to suppress one another, and two-tone suppression has been cast as an instance of lateral inhibition. Consequently, spectral peaks in the internal representation for hearing-impaired (HI) listeners, as opposed to normal-hearing (NH) listeners, are less intense relative to spectral contrast that is reduced and more susceptible to noise. Not only are spectral peaks harder to resolve in noise due to reduced amplitude differences between peaks and valleys, but their internal representation is spread out over wider frequency regions (smeared), resulting in less precise frequency analysis, blurring between frequency varying formant patterns, and ultimately in greater confusions between sounds with similar spectral shapes.

Simultaneous spectral contrast is the intensity difference between peaks and valleys in the spectral shape of different speech sounds. Spectral peaks (formants) reflecting vocal tract resonances are important acoustic features that help define the identity of many speech sounds. A number of experimental techniques confirm that the internal representation of spectral contrast for steady state speech sounds, like vowels, is reduced in HI compared to NH listeners. For example, it has been found that peaks in vowel masking patterns for HI listeners were not resolved as well as for NH listeners, and that peak frequencies in the internal representations were often shifted away from their corresponding formant frequencies.

Decreased signal-to-noise ratios in the internal spectrum also results from auditory filters broadened by SNHL. Others found a relationship between HI listeners' estimated auditory filter bandwidths in the region of the second formant (F2) and the amount of spectral contrast needed to identify vowels in noise. These findings indicate that noise effectively reduces internal spectral contrast and that deleterious effects of noise can be offset to some extent by an increase in spectral contrast. Similarly, it has been indicated that there is a general trading relationship between spectral resolution and the amount spectral contrast needed for vowel identification.

As stated, historically, the primary function of hearing aids is to make speech in regions of hearing loss comfortably audible. Unfortunately, in this effort, hearing aids can increase the blurring of detailed frequency information by reducing internal representations of spectral contrast in at least three ways: 1) high output levels; 2) positive spectral tilt; and 3) compression (decreased dynamic range).

First, it is well known that auditory filter tuning is level dependent. Even NH listeners experience decreased frequency selectivity at high levels needed to overcome sensitivity loss for HI listeners. In ears with SNHL, high presentation levels contribute to further reductions in frequency tuning and greater smearing of spectral detail already associated with the loss of nonlinear mechanisms.

Second, hearing aids typically provide high-frequency emphasis, or a positive spectral tilt, to compensate for increases in hearing loss with frequency. However, it has been indicated that positive spectral tilt for NH listeners actually reduces the internal representation of higher frequency formants and increases the need for greater spectral contrast. Thus, it has been hypothesized that this might occur because internal representations of some formants are characterized by 'shoulders' rather than peaks—as a spectral 'irregularity' on the skirt of a more intense formant. Using an auditory filter model, it has been demonstrated that increases in spectral tilt raise the probability that a formant will be represented as a shoulder rather than a peak (similar to increases in filter bandwidth), but suppression can serve to convert (enhance) some of these shoulders into peaks. It is likely that negative effects of increased spectral tilt in NH listeners are exacerbated in HI listeners with already poor auditory filter tuning and reduced/absent mechanisms for suppression.

Third, it has long been suspected that multichannel compression in hearing aids, which is designed to accommodate different dynamic ranges of audible speech with frequency, has the potential to reduce spectral contrast and flatten the spectrum, especially when there are many independent channels and/or high compression ratios. Notably, several studies have found that compression across many independent channels increases errors for consonants differing in place of articulation, which can be highly influenced by subtle changes in spectral shape. Some have not only reported a significant decrease in vowel identification with an increase in independent compression channels, but also found that identification and number of channels were each directly related to acoustic measures of spectral contrast.

Spectral contrast is not only important for detecting differences between static spectral shapes, but also for detecting changes, which are made more subtle by coarticulation in connected speech. For example, considering the case of a formant that ends with closure silence and begins again (after closure) at a slightly higher or lower frequency. For the HI listener, there would be no perceived difference in the offset and onset frequencies, as both would be processed by the same broadened auditory filter (i.e., the change in frequency across time would be blurred). Such would not be the case for the NH listener. Instead, contrastive process operating across time would serve to "repel" these spectral prominences making them more distinct. Most conventional hearing aid processing strategies are designed to increase audibility of speech information and to improve signal-to-noise ratio by manipulating relative intensities of speech and noise. Unfortunately, these processing strategies do not adequately address the challenges of listeners with mild SNHL who experience reductions in spectral contrast as a consequence to the intensity manipulations of the processing, nor the challenges of listeners with moderate to severe hearing loss who suffer from additional reductions in spectral contrast and increased distortion arising from cochlear damage and broadened auditory filters.

Like hearing aid users, spectral blurring experienced by cochlear implant (CI) listeners is attributable to impaired cochlear/neural functioning and to device processing that is necessary to accommodate the impairment. Severe amplitude compression is needed to fit the relatively large dynamic range of speech (about 50 dB, including the effects of vocal effort) into a restricted dynamic range of electrical stimulation (often, 5-15 dB). Furthermore, a limited number of useable electrodes (typically, between 6 and 22) are available to CI listeners, who most often cannot take full advantage of even this limited spectral information provided by their electrode arrays. This is demonstrated by speech tests in quiet and in noise and by tests measuring discrimination of spectral ripples where performance as a function of number of active electrodes asymptoted at 4-7, even though the CI listeners could use a greater number in isolation for simple pitch and level discriminations. Thus, the effective number of channels for spectrally rich sounds like speech is less than the number of active electrodes.

Limited use of available spectral detail in patterns of stimulation from the CI processor is likely due to the reduced specificity of stimulation attributable to current spread, and to decreased survival and function of spiral ganglion cells. Consequently, compared to NH listeners, CI listeners need, for example, at least 4-6 dB greater spectral contrast for vowel identification in quiet and need even greater signal-to-noise ratios (SNRs) for speech in noise. Tests using NH listeners with simulated CI processing (vocoded speech) indicate that while as few as 8-12 channels might be sufficient for very good speech understanding in quiet. As many as 20 might be needed to adequately understand speech in contexts known to be exceptionally challenging for CI listeners, particularly, competing background noise, multiple talkers, and low linguistic redundancy. As with hearing aid users, transient burst onsets and rapid formant frequency changes that distinguish consonants differing in place of articulation are most troublesome for CI listeners.

To aid speech understanding in noise, some devices include noise reduction schemes and directional microphones. CI coding strategies, like spectral peak coding strategy (SPEAK) for example, analyze incoming speech into a bank of filters (e.g., 20) and use the outputs from a small number of them (e.g., 6) to stimulate corresponding places on the electrode array. CI listeners largely rely on relative differences in across-channel amplitudes to detect formant frequency information, and this is especially problematic when there is competing noise or a small number of effective channels. Furthermore, because nonlinear processes are abolished either by the impairment itself or by placement of the electrode array, natural spectral enhancement is also lost.

Thus, systems and methods for speech processing and recognition and systems and methods for manipulating audio signals including speech to improve the understanding of HI and CI listeners must balance a wide variety of variables and unknowns and continue to have long-standing need for improvement.

SUMMARY OF THE INVENTION

The present invention provides a system and method for audio signal enhancement for speech processing and/or recognition and enhancement. Unlike traditional systems, the present invention recognizes that, although counterintuitive, contrast enhancement, when applied across the entire spectrum and/or when not applied in a highly-selective or judicious manner, can actually impede a listener's or other recipient's ability to understand the underlying speech. The present invention provides a system and method to selectively manipulate or augment portions of an audio signal, for example, to allow portions of the audio signal to be enhanced and other portions of the audio signal to be unenhanced or enhanced differently. Accordingly, the present invention can be used so as to, at least, not reduce an ability of a receiving entity to process the unenhanced or differently-enhanced portions of the audio signal.

In accordance with one aspect of the present invention, a hearing aid system is provided that is configured to be coupled with an ear of an individual to selectively enhance an acoustic signal to be received by the ear of the individual. The system includes a microphone configured to receive the acoustic signal and generate an analog electrical signal responsive thereto and an analog-to-digital converter configured to receive the analog electrical signal and convert the analog electrical signal into a digital input signal. The system also includes a signal processor configured to receive the digital input signal and programmed to divide the digital input signal into a plurality of spectral channels having associated unenhanced signals. The signal processor is also configured to perform enhancement processing on a first subset of the spectral channels having associated unenhanced signals corresponding to a pathological response range of the ear of the individual and not perform enhancement processing on a second subset of the spectral channels having associated unenhanced signals outside the pathological response range of the ear of the individual. Furthermore, the signal processor is configured to combine the plurality of enhanced signals associated with each of the first subset of the spectral channels and the unenhanced signals associated with each of the second subset of the spectral channels to form a selectively enhanced output signal. The system also includes an output device configured to receive the selectively enhanced output signal and communicate the selectively enhanced output signal to the individual through the ear of the individual.

In accordance with another aspect of the present invention, a method is provided to divide an input auditory signal into a plurality of spectral channels having associated unenhanced signals and perform enhancement processing on a first subset of the spectral channels and not perform enhancement processing on a second subset of the spectral channels. The enhancement processing is performed by determining an output gain for at least the first subset of spectral channels based on a time-varying history of energy of the unenhanced signals associated with each channel in the first subset of the spectral channels and applying the output gain for each of the first subset of the spectral channels to the unenhanced signals to form enhanced signals associated with each of the first subset of the spectral channels. The system and method are then designed to combine the plurality of enhanced signals associated with each of the first subset of the spectral channels and the unenhanced signals associated with each of the second subset of the spectral channels to form a selectively enhanced output auditory signal.

In accordance with another aspect of the present invention, a system for selectively enhancing an acoustic signal is provided that includes a microphone configured to receive an acoustic signal and generate an analog electrical signal responsive thereto and an analog-to-digital converter configured to receive the analog electrical signal and convert the analog electrical signal into a digital input signal. The system also includes a signal processor configured to receive the digital input signal and programmed to divide the digital input signal into a plurality of spectral channels having associated unenhanced signals and perform enhancement processing on a first subset of the spectral channels and not perform enhancement processing on a second subset of the spectral channels. The signal processor is also programmed to combine the plurality of enhanced signals associated with each of the first subset of the spectral channels and the unenhanced signals associated with each of the second subset of the spectral channels to form a selectively enhanced output signal. The system also includes an output device configured to receive the selectively enhanced output signal and communicate the selectively enhanced output signal.

Additional features and advantages of the present invention will be apparent from the following detailed description taken in conjunction with the accompanying drawings.

DETAILED DESCRIPTION OF THE INVENTION

The present invention provides a system and method for using contrast enhancement (CE) algorithm that is specifically designed to confine enhancement to portions of the spectrum and allow those portions to be selected and highly customized. For example, a CE algorithm may be employed that is designed to enhance spectral differences between adjacent sounds and thereby improve speech intelligibility for hearing impaired (HI) listeners by enhancing signature kinematic properties of connected speech, but is restricted to being applied to portions of the audio spectrum. The CE algorithm may be designed to achieve enhancement of spectral contrast across time, or successive spectral contrast, in addition to enhancement of simultaneous spectral contrast.

The present invention may be employed in electronic hearing aid devices for use by the hearing impaired, particularly for purposes of enhancing the spectrum such that impaired biological signal processing in the auditory brainstem is restored. This process enhances spectral differences between sounds in a fashion mimicking that of non-pathological human auditory systems. The process imitates neural processes of adaptation, suppression, adaptation of suppression, and descending inhibitory pathways, and does not impede functions that are more akin to natural, non-impaired processes by selectively controlling the enhancements. The present invention makes sounds, particularly speech sounds, more distinguishable to listeners and other receivers. Thus, the present invention is applicable to uses other than hearing aids, such as speech recognition systems.

The present invention recognizes that, for many HI listeners, amplification is used to make a signal audible, but because of limited dynamic range, spectral resolution deteriorates at amplified presentation levels. The invention addresses this problem by the manipulation of the spectral composition of the signal to overcome some of the loss of spectral resolution, and to substitute to some extent for additional amplification (which becomes deleterious at higher levels). By selectively applying such enhancements, the present invention avoids the common problems caused by enhancements applied to the entire dynamic spectrum.

Figure 1:
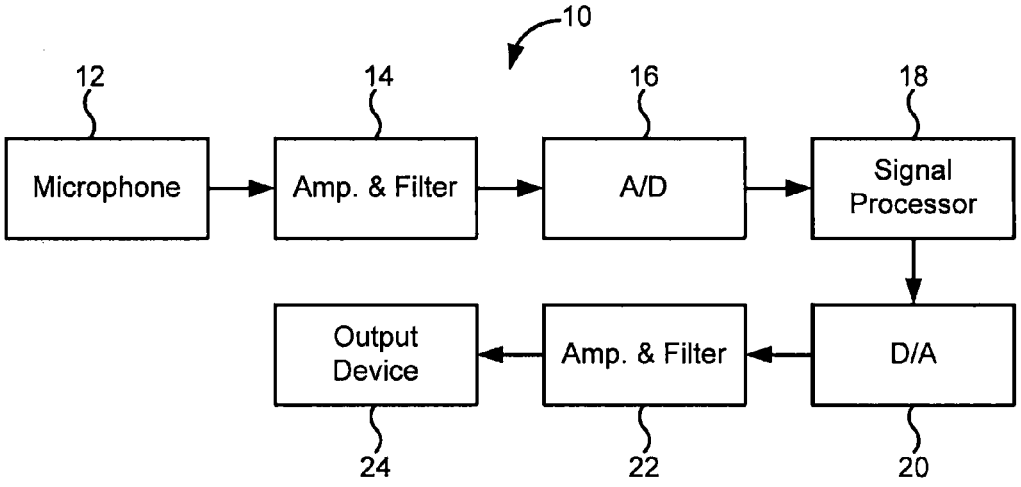
FIG. 1 is a schematic block diagram of an electronic hearing aid device configured to selectively enhance an audio signal in accordance with the present invention.
Figure 2:
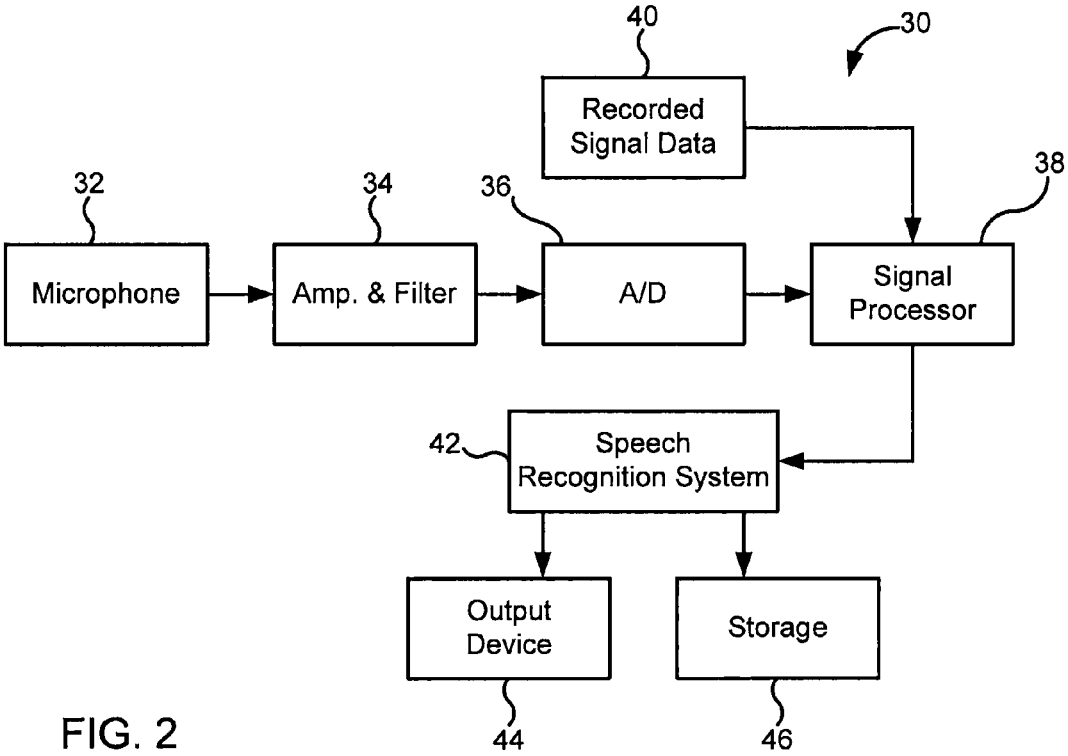
FIG. 2 is a schematic block diagram of a speech recognition system configured to selectively enhance an audio signal in accordance with the present invention.

Referring to FIGS. 1 and 2, the present invention may include a hearing aid apparatus 10 as illustrated in FIG. 1 or a speech recognition system 30 as illustrated in FIG. 2. For purposes of illustration, a general hearing aid system 10 includes a microphone 12 for receiving audio signals and converting the signals into electrical signals, an amplification and filtering component 14, an analog-to-digital converter 16, a signal processor 18, a digital-to-analog converter 20, additional filters and amplifiers 22, and an output device 24, such as a cochlear implant or a speaker that converts the amplified signal to sound for the hearing impaired listener. Similarly, the speech recognition system 30 may receive sound from a microphone 32 that converts the sound to an analog signal presented to an amplifier and filter 34, the output of which is provided to an analog-to-digital converter 36, which provides digital data to a signal processor 38. The signal processor 38 in this case may be implemented in a general purpose computer. Alternatively, recorded signal data may be provided from a recording system 40 directly to the signal processor 38. The output of the signal processor 38 is provided to a speech recognition system 42, which itself may be a general purpose computer (and the speech recognition system 42 and the signal processor 38 may both be implemented using the same computer), with the output of the speech recognition system 42 provided to output devices 44 (hard copy, video displays, etc.), or to digital storage media 46.

As will be described, the present invention provides a contrast enhancement algorithm and selective control mechanism designed to manipulate the spectral composition of speech sounds across time such that spectral prominences (formants) are spread apart in frequency in an effort to make them sufficiently distinct to overcome spectral blurring that occurs with a combination of SNHL, background noise, increased presentation levels, high-frequency gain, and multichannel compression. However, unlike traditional systems, the present invention recognizes that, although counterintuitive, contrast enhancement, when applied across the entire spectrum and/or when not applied in a highly selective, judicious manner, can actually impede a listener's or other recipient's ability to understand the underlying speech. To provide a high degree of contrast without a corresponding degradation or distortion created by applying contrast enhancement to, for example, portions of the spectrum that may not substantially benefit from enhancement or, when considering the entire spectrum, may ultimately reduce the overall contrast, the present invention is designed to selectively apply enhancement.

Where auditory filtering is relatively normal, any signal manipulation including contrast enhancement distorts information and perceived "naturalness." Traditional attempts to improve speech recognition in HI listeners via simultaneous spectral enhancement employed enhancement uniformly across the spectrum, which is one likely reason for their less-than-favorable outcomes. The present invention provides systems and method for customized enhancement so that it is present, for example, only where there is significant hearing loss. For example, for listeners with mild low-frequency hearing loss sloping to moderately severe in the high frequencies, a uniform degree of enhancement might be too great in the low frequencies, thereby unacceptably distorting the signal (e.g., increasing F1 intensity too much, contributing to upward spread of masking of F2), but still insufficient in higher frequencies where it is needed most. Customization of spectral enhancement represents a significant innovation over prior methods.

Figure 3:
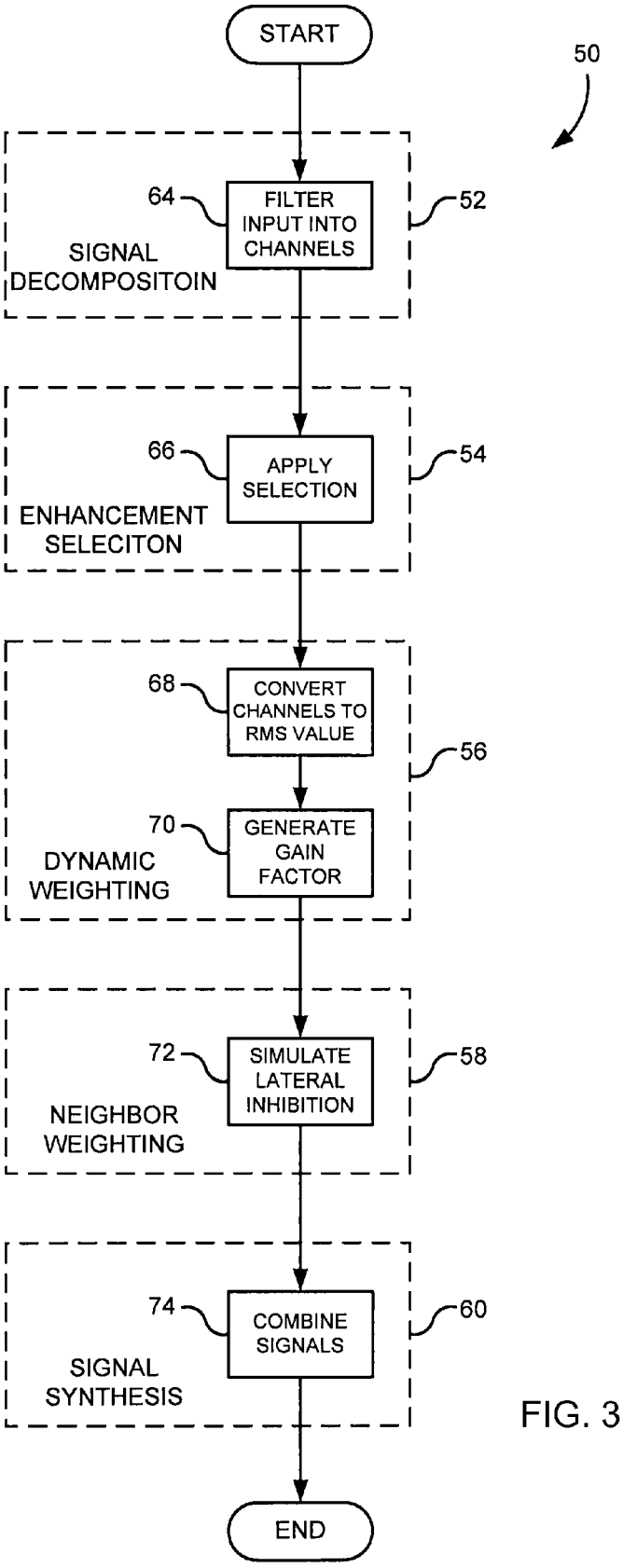
FIG. 3 is a flow chart setting forth the steps of a method for selective enhancement of audio signals in accordance with the present invention.

Referring now to FIG. 3, a flow chart is provided that illustrates the steps of a selective enhancement method 50 in accordance with the present invention. As illustrated, the present method can be broken into a plurality of subcomponents, including signal decomposition into a plurality channels 52, selective application of enhancement 54, weighting of channel output according to time via a dynamic compressive gain function 56, weighting of channel gain within frequency neighborhoods via an inhibitory network 58, and signal synthesis 60.

Figure 4:
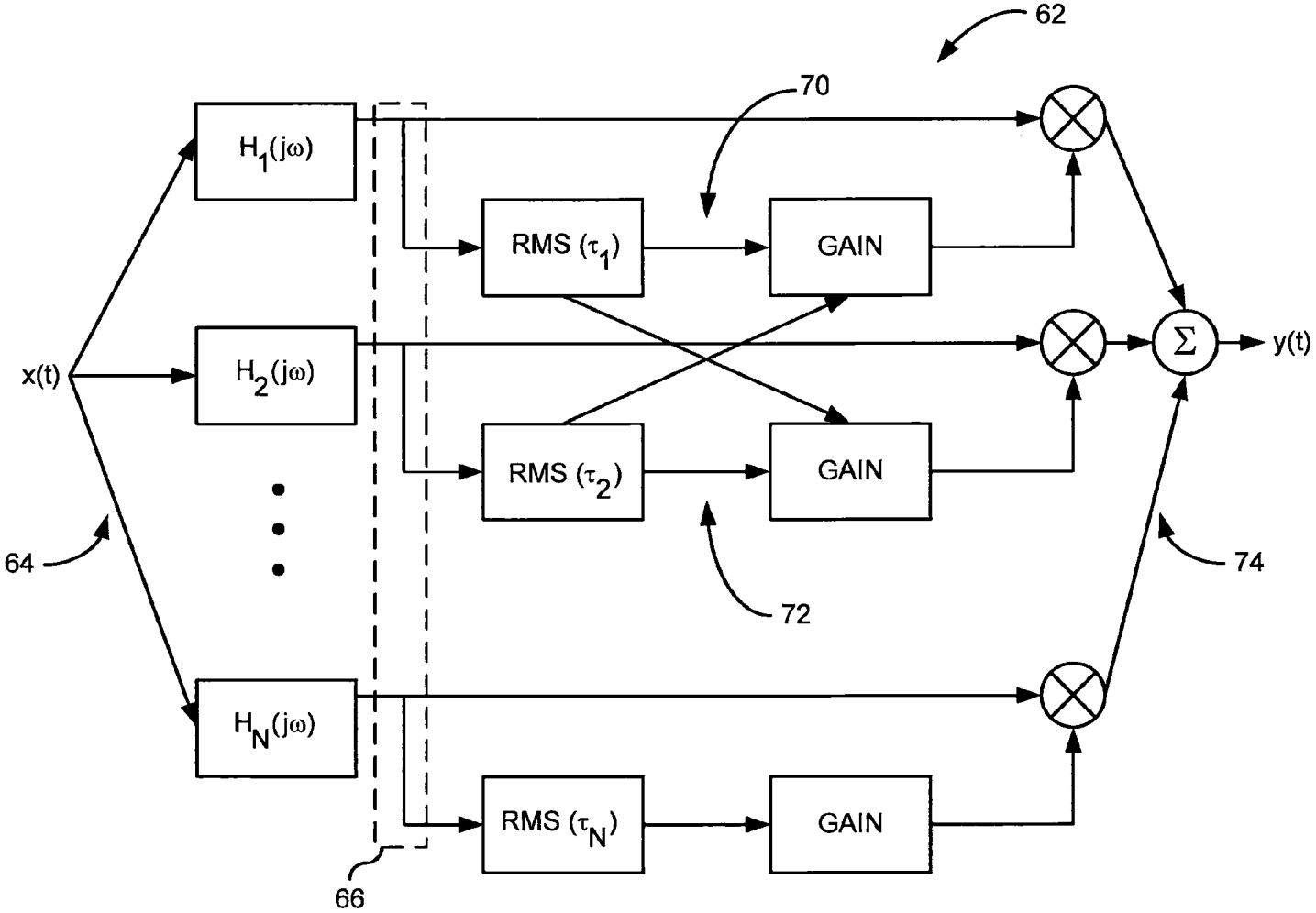
FIG. 4 is a schematic illustration of an exemplary architecture for selectively enhancing an audio signal in accordance with the present invention.

Referring now to FIGS. 3 and 4, the specific steps of this method 50 and an overview of a system architecture 62 for implementing the method 50 will be described. At process block 64, an input signal, x(t), is received and filtered into a plurality of narrowband channels (e.g., 100-Hz bandwidth), $H_i(j\omega)$. Narrow filters are desirable for manipulating amplitudes of individual harmonics including formants to sharpen simultaneous spectral contrast and to enhance successive spectral differences across time. That is, narrow filters are desirable for increasing peak harmonic amplitude and decreasing amplitudes of immediately adjacent harmonics and skewing peak harmonic energy away from where formant energy had been in the immediate past.

Thereafter, at process block 66, channel selection for enhancement is applied. Specifically, after the input acoustic signal, x(t), is divided into a plurality of spectral channels at process block 64, channel selection for enhancement is applied such that only some of the channels are selectively enhanced. It is contemplated that this may be achieved, for example, using a block Toeplitz submatrix. The block Toeplitz submatrix may be constructed such that the spectral channels that remain unprocessed are instantiated by an identity submatrix. The channels that are selectively processed correspond to negative off-diagonal entries, for example, as illustrated in the following exemplary submatrix:

$$\begin{bmatrix} \begin{bmatrix} 1 & 0 & 0 \\ 0 & 1 & 0 \\ 0 & 0 & 1 \end{bmatrix} & \begin{matrix} 0 & 0 & 0 \\ 0 & 0 & 0 \\ 0 & 0 & 0 \end{matrix} & \begin{matrix} 0 & 0 & 0 \\ 0 & 0 & 0 \\ 0 & 0 & 0 \end{matrix} \\ \begin{matrix} 0 & 0 & 0 \\ 0 & 0 & 0 \\ 0 & 0 & 0 \\ 0 & 0 & 0 \\ 0 & 0 & 0 \\ 0 & 0 & 0 \end{matrix} & \begin{matrix} 1 & -2 & 0 \\ -2 & 1 & -2 \\ 0 & -2 & 1 \\ 0 & 0 & -2 \\ 0 & 0 & 0 \\ 0 & 0 & 0 \end{matrix} & \begin{matrix} 0 & 0 & 0 \\ 0 & 0 & 0 \\ -2 & 0 & 0 \\ 1 & -2 & 0 \\ -2 & 1 & -2 \\ 0 & -2 & 1 \end{matrix} \end{bmatrix}$$

Thereafter, at process block 68, a weighted time history (e.g., 30-300 ms buffer) of the energy passing through each channel to be enhanced is converted into an RMS value. This adaptation stage can be implemented using dynamic compression with a nonlinear convex loss function, such that more recent energy passing through a channel is given greater weight than earlier occurring energy (i.e., a leaky temporal integrator).

At process block 70, the RMS value of the weighted history is converted to a gain factor for the associated channel. For example, the RMS value of the weighted history may be subtracted from unity (1) to yield a gain factor for that channel. The greater the weighted history of energy, the smaller the gain is. Maximum gain (1) is assigned when the weighted history is zero. In this way, processes of adaptation are mimicked and contribute to competition between channels.

Thereafter, at process block 72, processes of lateral inhibition are simulated. This may be achieved in the way gain is balanced across weighted frequency neighborhoods of channels. To this end, it is contemplated that a winner-take-all circuit may be used to simulate a biological network of inhibitory sidebands. Energy in a channel with a relatively high gain factor is increased at the expense of a decrease in adjacent channels with relatively low gain factors. In essence, the channel activities "compete" on a moment-by-moment basis.

The collective effects of the windowed RMS calculation (dynamic compressive gain) and lateral interactions within frequency neighborhoods results in a form of forward energy suppression specifically designed to enhance the spectrum across time. When an individual channel has relatively high energy in the past, it will tend to suppress its current energy under the condition that its neighboring channels were low in energy. This form of suppression will have the effect of sharpening dynamic modes in the spectrum, especially onsets, while flattening those that are relatively steady state, and in this way, will serve to enhance temporal contrasts. Enhancement of temporal contrasts in speech can especially aid stop consonant perception by emphasizing low-intensity transient energy characteristic of burst onsets and rapid formant transitions.

Consider the case of a single formant traversing frequency. As the formant increases in frequency, the CE algorithm successively attenuates lower-frequency filters through which the spectral prominence has already passed. This has two consequences. First, the shoulder on the low-frequency side of the formant will be sharpened because that is where the most energy was immediately prior. This will serve to "sharpen" the spectrum as compensation for "blurring" caused by an impaired cochlea. Second, the effective frequency (center of gravity) of the formant peak will be skewed away from where the formant had been before. Consequently, successive contrast will be imposed on the signal (spreading successive formants apart in frequency). It also is the case that a formant transition will be "accelerated" via this process. Because the CE algorithm successively attenuates the low-frequency shoulder, the effective slope of the processed formant becomes steeper.

The analysis and synthesis components of the above-described contrast enhancement method and circuit may employ a polyphase decomposition and oversampled discrete Fourier transformed (DFT) modulated filters. That is, as described, the input signal may be first decomposed into a plurality of subbands and CE performed within neighborhoods of subbands, then the subband process can be reversed to reconstruct the output signal. A subband scheme can utilize an analysis filter bank that splits the input into a set of M narrowband signals that are typically downsampled (decimated) by some factor N leading to more efficient processing. Intermediate processing can be performed and the constituents subsequently combined using a synthesis filter bank that is then upsampled (interpolated) by a factor of N. If no intermediate processing is performed, it is generally acknowledged that the input can be perfectly reconstructed at the output of the circuit along with some measure of pure delay. The M subband filters are derived by frequency shifting a well-constructed prototype low-pass filter h[t]. Polyphase decomposition groups the analyzing prototype filter h[t] into M subsequences prior to Fourier transformation. This segmented representation allows rearrangement of the filtering computations and increases the speed of processing approximately M-fold. The output signal is then reconstructed using a synthesis bank containing the inverse DFT matrix and the reconstruction matrix.

Referring again to FIGS. 3 and 5, at process block 74, the channels are combined together with phase information to yield a selectively, contrast-enhanced signal, y(t). Keeping in mind that, as described above, the block Toeplitz submatrix may be constructed such that the spectral channels that remain unprocessed are instantiated by an identity submatrix, the reconstruction of the channels into the selectively contrast-enhanced signal, y(t), is achieved by combining the plurality of enhanced signals and the unenhanced signals.

Figure 5A:
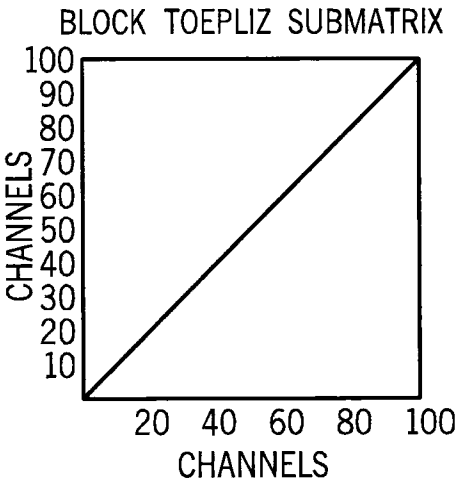
FIGS. 5*a*-5*c* are graphs illustrating selective spectral contrast enhancement to a plurality of channels in accordance with the present invention.
Figure 5B:
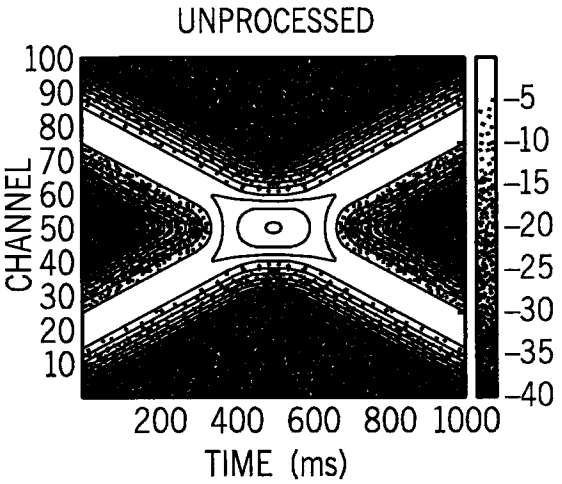
Figure 5C:
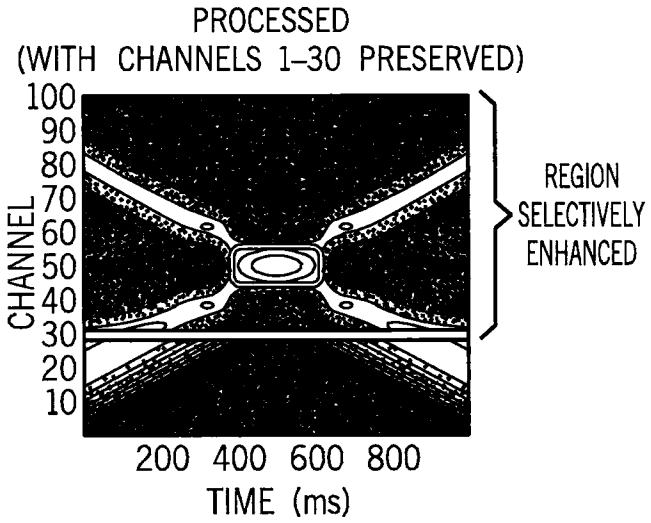

Specifically, referring to FIGS. 5*a*-5*c* and the above-described selective application of the enhancement algorithm, it can be seen that the contrast-enhanced signal, y(t), can be highly controlled such that enhancement is only applied as desirable. Specifically, the block Toeplitz submatrix described above is illustrated as having been flipped in FIG. 5*a*. The synthetic acoustic signal decomposed into subbands is shown unprocessed in FIG. 5*b* and is illustrated as having been selectively processed by using the above-described modified Toeplitz matrix. As illustrated when comparing FIGS. 5*b* and 5*c*, channels 1 to 30 remain unchanged, and 31 to 100 are significantly sharpened as a consequence of contrast enhancement. Thus, as illustrated, in the present invention, by recognizing that, for example, impairment rarely extends across the entire frequency range of hearing, and providing a highly-controllable mechanisms for controlling enhancement, provides the ability to restrict the contrast enhancement to only the pathological channels. For example, most commonly, hearing loss is most severe at higher frequencies; although, listeners can have selective losses at other frequencies. The present invention allows selection and user-adjustment of those areas that are to be enhanced and those that will remain unenhanced.

The above-described systems and method for selective contrast enhancement may be coupled with a variety of additional processing techniques. For example, nonlinear frequency compression remaps high-frequency information above a certain start frequency into a smaller bandwidth, while leaving low frequencies below the start frequency unaltered. This represents an advance in hearing aid processing. One limitation to this new technology is that spectral contrast between peaks in the spectrum is reduced, thereby exacerbating the already limited spectral resolution of the impaired cochlea. Pre- or post-processing, frequency-compressed speech coupled with the above-described selective CE systems and methods help overcome some of this reduction in spectral contrast and allows one to effectively select the areas of compression and areas of remapped high-frequency information without disturbing areas of the spectrum that an impaired individual is capable of processing substantially normally.

Similarly, because many sources of background noise tend to be stationary and because the present CE algorithm attenuates static spectral features, noise reduction is a natural byproduct of the processing that could augment or replace existing noise reduction strategies (e.g., spectral subtraction). Along a similar line of reasoning, a persistent spectral peak associated with acoustic feedback in hearing aids could be eliminated with the CE algorithm and replace other, less desirable, feedback cancellation strategies, such as, notch filtering and a reduction in much needed high-frequency gain. Yet again, the above-described selective CE systems and methods allow one to select areas of processing and others to remain substantially unprocessed.

Thus, the present invention recognizes that impairments rarely extends across the entire frequency range of hearing. Rather, most commonly, hearing loss is most severe at specific frequencies, such as higher frequencies; although, listeners can have selective losses at other frequencies. Similarly, the present invention recognizes that normal receivers rarely benefit from enhancements or the like being applied across the full listening spectrum. For example, such "enhancement" signal processing often introduces distortion. With this recognition in place, the present invention provides a system and method to restrict contrast enhancement to only, for example, "pathological" channels or other designated channels that can benefit from enhancement without being overridden by distortion or other negative effects.

It is understood that the present invention is not limited to the specific applications and embodiments illustrated and described herein, but embraces such modified forms thereof as come within the scope of the following claims.

What is claimed is:

1. A hearing aid system configured to be coupled with an ear of an individual to selectively enhance an acoustic signal to be received by the ear of the individual, comprising:

a microphone configured to receive the acoustic signal and generate an analog electrical signal responsive thereto;

an analog-to-digital converter configured to receive the analog electrical signal and convert the analog electrical signal into a digital input signal;

a signal processor configured to receive the digital input signal and programmed to:

divide the digital input signal into a plurality of spectral channels having associated unenhanced signals;

identify a first subset of the spectral channels having associated unenhanced signals corresponding to a pathological response range of the ear of the individual;

identify a second subset of the spectral channels having associated unenhanced signals outside the pathological response range of the ear of the individual;

perform enhancement processing on the first subset of the spectral channels and not perform enhancement processing on any of the second subset of the spectral channels; and combine the plurality of enhanced signals associated with each of the first subset of the spectral channels and the unenhanced signals associated with each of the second subset of the spectral channels to form a selectively enhanced output signal; and an output device configured to receive the selectively enhanced output signal and communicate the selectively enhanced output signal to the individual.

2. The system of claim 1 wherein the pathological response range corresponds to an audio frequency range within which the ear of the individual has a pathological response.

3. The system of claim 1 wherein the output device includes a speaker.

4. The system of claim 1 wherein the output device includes a cochlear implant.

5. The system of claim 1 wherein the signal processor is configured to use a channel selection criteria designated by a matrix corresponding to the plurality of spectral channels to perform enhancement processing on a first subset of the spectral channels and not perform enhancement processing on a second subset of the spectral channels.

6. The system of claim 5 wherein the matrix includes a block Toeplitz submatrix configured to make the second subset of the spectral channels instantiated by an identity submatrix.

7. The system of claim 1 wherein the signal processor, to perform enhancement processing, is further programmed to:

determine an output gain for at least the first subset of spectral channels based on a time-varying history of energy of the unenhanced signals associated with each channel in the first subset of the spectral channels; and apply the output gain for each of the first subset of the spectral channels to the unenhanced signals associated with the respective channel in the first subset of the spectral channels to form enhanced signals associated with each of the first subset of the spectral channels.

8. A method for selectively enhancing an auditory signal, comprising the steps of:

(a) dividing an input auditory signal into a plurality of spectral channels having associated unenhanced signals;

(b) performing enhancement processing on a first subset of the spectral channels and not performing enhancement processing on any of a second subset of the spectral channels, wherein the enhancement processing includes:

(i) determining an output gain for at least the first subset of spectral channels based on a time-varying history of energy of the unenhanced signals associated with each channel in the first subset of the spectral channels; and (ii) applying the output gain for each of the first subset of the spectral channels to the unenhanced signals associated with the respective channel in the first subset of the spectral channels to form enhanced signals associated with each of the first subset of the spectral channels; and (c) combining the plurality of enhanced signals associated with each of the first subset of the spectral channels and the unenhanced signals associated with each of the second subset of the spectral channels to form a selectively enhanced output auditory signal.

9. The method of claim 8 wherein step (b) includes applying a channel selection criteria designated by a matrix corresponding to the plurality of spectral channels.

10. The method of claim 9 wherein the matrix includes a block Toeplitz submatrix configured to make the second subset of the spectral channels instantiated by an identity submatrix.

11. The method of claim 8 wherein a magnitude of the output gain for each of the first subset of spectral channels is inversely related to the history of energy of the unenhanced signals associated with each channel in the first subset of the spectral channels.

12. The method of claim 8 wherein the step (a) includes the step of applying the input auditory signal to a plurality of polyphase multirate filters.

13. The method of claim 8 wherein the step (b)(i) includes the steps of determining a weighted energy history for each channel based on the time varying history of the energy in the channel, converting the weighted energy history into an RMS history weighting value, and determining the output gain for the channel using the RMS history weighting value.

14. The method of claim 13 wherein the step of determining the weighted energy history for each channel includes weighting more recent energy in the channel more heavily than less recent energy in the channel.

15. A system for selectively enhancing an acoustic signal, comprising:

a microphone configured to receive an acoustic signal and generate an analog electrical signal responsive thereto;

an analog-to-digital converter configured to receive the analog electrical signal and convert the analog electrical signal into a digital input signal;

a signal processor configured to receive the digital input signal and programmed to:

divide the digital input signal into a plurality of spectral channels having associated unenhanced signals;

perform enhancement processing on a first subset of the spectral channels and not perform enhancement processing on a second subset of the spectral channels, the spectral channels in the first subset of the spectral channels and the spectral channels in the second subset of the spectral channels being mutually exclusive; and combine the plurality of enhanced signals associated with each of the first subset of the spectral channels and the unenhanced signals associated with each of the second subset of the spectral channels to form a selectively enhanced output signal; and an output device configured to receive the selectively enhanced output signal and communicate the selectively enhanced output signal.

16. The system of claim 15 wherein the output device includes a speaker configured to communicate the selectively enhanced output signal as an acoustic signal.

17. The system of claim 15 wherein the output device includes a digital-to-analog converter configured to convert the selectively enhanced output signal to an analog electrical output signal.

18. The system of claim 15 wherein the microphone, analog-to-digital converter, and signal processor system are contained in a hearing aid.

19. The system of claim 15 wherein the output device includes a speech recognition system including a display configured to communicate text corresponding to the selectively enhanced output signal.

20. The system of claim 15 wherein the signal processor, to perform enhancement processing, is further programmed to:

determine an output gain for at least the first subset of spectral channels based on a time-varying history of energy of the unenhanced signals associated with each channel in the first subset of the spectral channels; and apply the output gain for each of the first subset of the spectral channels to the unenhanced signals associated with the respective channel in the first subset of the spectral channels to form enhanced signals associated with each of the first subset of the spectral channels.

* * * * *